United States Patent [19]

Chenet

[11] 4,095,567

[45] Jun. 20, 1978

[54] CARBURATION DEVICES WITH IDLE ADJUSTMENT

[75] Inventor: Jacques L. Chenet, Sevres, France

[73] Assignee: Societe Industrielle de Brevets et d'Etudes S.I.B.E., France

[21] Appl. No.: 693,124

[22] Filed: Jun. 4, 1976

[30] Foreign Application Priority Data

Jun. 26, 1975 France ..... 75 20163

[51] Int. Cl.[2] ..... F02D 9/08

[52] U.S. Cl. ..... 123/103 R; 123/103 E; 261/DIG. 18

[58] Field of Search ..... 123/97 R, 97 B, 103 R, 123/103 C, 103 D, 103 E; 261/DIG. 18, DIG. 19, 41 D, 65; 267/123; 251/54; 92/48

[56] References Cited

U.S. PATENT DOCUMENTS

| | | | |
|---|---|---|---|
| 2,692,651 | 10/1954 | Ball | 261/DIG. 18 |
| 3,072,111 | 1/1963 | Cramer | 123/103 R |
| 3,327,695 | 6/1967 | Rhodes | 261/DIG. 18 |
| 3,370,577 | 2/1968 | Guetersloh | 123/103 R |
| 3,502,000 | 3/1970 | Voges | 123/103 R |
| 3,547,089 | 12/1970 | Pierlot | 261/DIG. 19 |
| 3,577,962 | 5/1971 | Ojala | 123/103 R |
| 3,623,465 | 11/1971 | Wawrziniok | 123/103 E |
| 3,677,526 | 7/1972 | Pierlot | 261/DIG. 19 |
| 3,744,471 | 7/1973 | Braun | 123/103 R |
| 3,752,141 | 8/1973 | Charron | 123/97 B |
| 3,752,450 | 8/1973 | Charron | 123/DIG. 11 |
| 3,768,450 | 10/1973 | Harrison | 123/103 R |
| 3,866,583 | 2/1975 | Pundt | 123/97 B |

FOREIGN PATENT DOCUMENTS

| | | |
|---|---|---|
| 1,055,510 | 1/1967 | United Kingdom. |

*Primary Examiner*—Charles J. Myhre
*Assistant Examiner*—William Randolph
*Attorney, Agent, or Firm*—Stevens, Davis, Miller & Mosher

[57] ABSTRACT

A carburetor for an internal combustion engine comprises a fuel idling circuit opening into the intake pipe downstream of a driver-actuated main throttle. Idle regulation means comprise a first pneumatic element connected to that part of the intake pipe downstream of the main throttle and a second pneumatic element having a movable part connected to the main throttle means by a unidirectional connection such that the throttle means can be opened to an additional extent. The second pneumatic element is subjected to the vacuum in a chamber connected to said part of the intake pipe and also connected to atmosphere by a valve carried by the movable part of the second element and opened by the first pneumatic element moving with respect to the second pneumatic element when there is an increase in the degree of vacuum in the intake pipe.

9 Claims, 3 Drawing Figures

CARBURATION DEVICES WITH IDLE ADJUSTMENT

BACKGROUND AND SUMMARY OF THE INVENTION

The invention relates to carburation devices for internal combustion engines which comprise an idling circuit opening into that part of the intake pipe downstream of a driver-operable main throttle member for delivering thereto a primary mixture of fuel and air, at least when the throttle member is in its minimum opening position, for which an air passage is left between the throttle member and the wall of the intake pipe.

The engine idles when the main throttle member is in the aforementioned minimum opening positon, i.e. when the accelerator pedal is released. When the main throttle member is progressively opened beyond the minimum opening position, there is an increase in the engine running speed as a result of the increase in the flow rate of air-fuel mixture supplied to the engine.

Usually, proper idling operation is obtained by suitably adjusting once for all the flow rates of air and fuel supplied to the engine under the aforementioned operating conditions. In modern motor vehicles, however, operating conditions are increasingly frequent in which the idling engine is suddenly loaded by the actuation of components of the vehicle (e.g. when the compressor of an air-conditioning system starts up, when an automatic gearbox operates, etc.). The load increase decreases the engine running speed and sometimes the engine stalls. To overcome that defect, means should be provided for maintaining the idling speed at a normal value when the engine is subjected to an additional load, e.g. by automatically opening the main throttle member (generally a butterfly valve) beyond its minimum opening position.

Various idling regulators have already been proposed for this purpose.

French patent specification No. 736,960 describes a device comprising a pneumatic element subjected to the underpressure which prevails downstream of the butterfly valve. That pneumatic element partly opens the butterfly valve when the underpressure falls below a threshold value, the partial opening being produced by a spring which opposes the underpressure force exerted on a diaphragm of the pneumatic element. When the spring expands, it moves an abutment secured to the butterfly valve.

This arrangement has a disadvantage: the opening of the butterfly valve is not controlled accurately since, under these circumstances, the spring acts against the considerable friction force in the linkage tending to maintain the accelerator linkage in the position for which the butterfly valve is in minimum opening condition.

French patent specification No. 1,594,991 discloses a pneumatic element comprising an aneroid capsule subjected to the underpressure which prevails downstream of a main throttle member and operatively connected to closure means adjusting the flow cross-sectional area of an additional air duct by-passing the throttle member; if the engine slows down when additionally loaded, the aneroid capsule retracts and the cross-sectional area of the additional air duct is increased. The additional air supplied to the intake manifold tends to increase the engine speed. If the stiffness of the capsule is appropriately selected, the amount of additional air admitted is sufficient to maintain the engine idling speed at is normal value. However, that arrangement, while it is suitable for adjusting the flow cross-sectional area of an additional air duct, is not adaptable for opening a main throttle member, which requires considerable mechanical force.

It is an object of the invention to provide a carburation device of the aforementioned kind provided with means for regulating the idling speed by adjusting the degree of opening of the main throttle member. It is a more precise object to provide such a device in which a pneumatic element sensitive to the underpressure downstream of the main throttle member is not subjected to substantial mechanical stress, apart from that produced by the underpressure in the intake pipe.

According to the invention, there is provided a device wherein the regulating means comprise a first pneumatic element connected to the part of the intake pipe which is located downstream of the main throttle member and a second pneumatic element having a movable part connected to the main throttle member by a unidirectional connection so that it can open the throttle member by an additional amount, the second pneumatic element being subjected to the pressure in a chamber connected to said part of the intake pipe and to atmosphere through a valve, said valve being carried by a movable part of the second element and being opened by the first pneumatic element responsive to movement of the latter with respect to the second pneumatic element upon an increase in the underpressure in the said part of the intake pipe.

The invention will be better understood from the following description of a non limitative embodiment of the invention. The description refers to the accompanying drawings.

SHORT DESCRIPTION OF THE DRAWINGS

Figure 1:
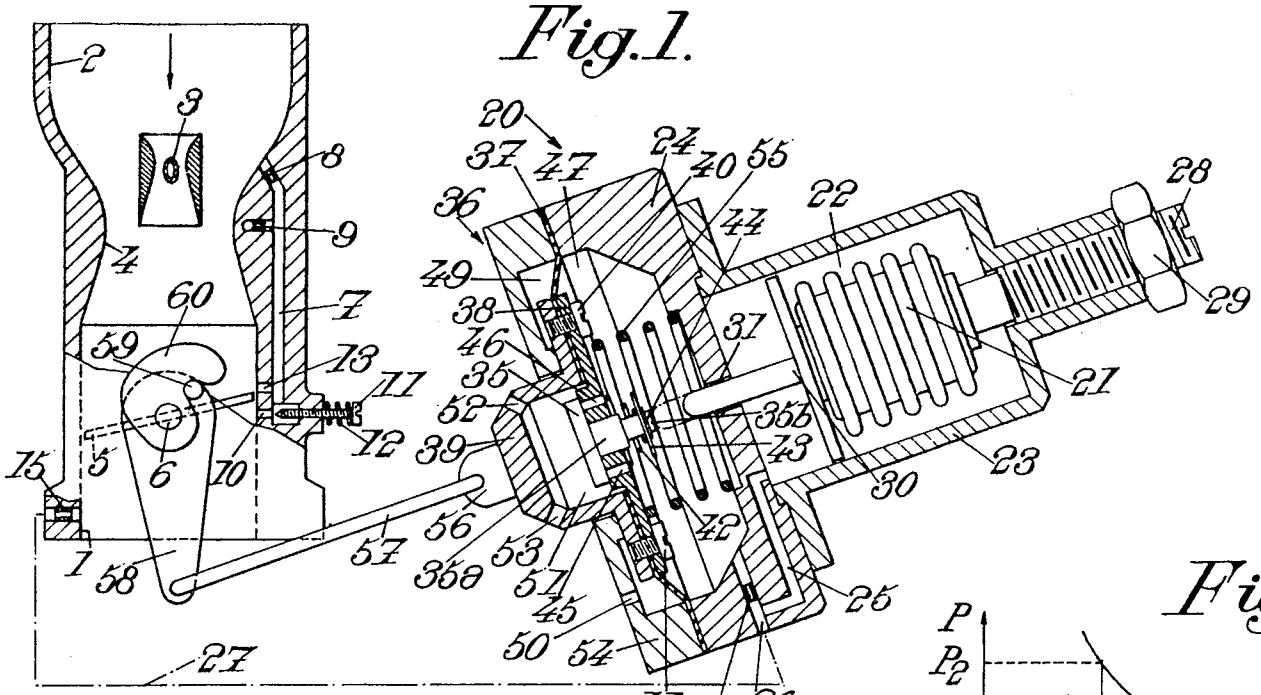
FIG. 1 is a cross-sectional view of the device, in the configuration when the engine is not running.
Figure 3:
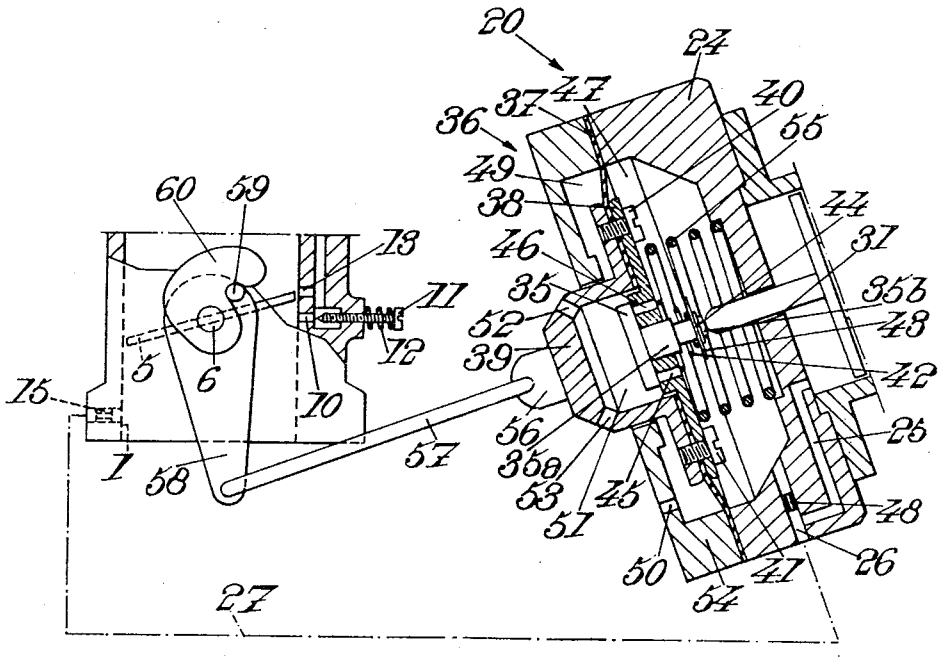

FIG. 3, similar to FIG. 1, shows a portion the device, with the components in the positions corresponding to idling under load.

DETAILED DESCRIPTION OF A PREFERRED EMBODIMENT

Referring to FIG. 1, there is shown a carburettor comprising a normal-operation fuel supply circuit and an idling circuit, both opening into an intake pipe 1. The intake pipe 1 comprises the following components in the air-flow direction, as indicated by an arrow: an air intake 2, a main fuel jet system 3 which opens at a venturi 4 and a main throttle member 5 which, in the present case, is a butterfly valve carried by a rotatable shaft 6 extending through the wall of pipe 1 so that the butterfly valve can be actuated by an operator via a linkage (not shown).

Conventional stop means (not shown) prevents the throttle member from closing beyond a predetermined minimum opening position which may be variable with the temperature.

The idling circuit comprises a duct 7 whose upstream end is connected to the air intake 2 via a calibrated orifice 8 and is also connected to a constant-level float chamber (not shown) via a calibrated orifice 9. The downstream end of duct 7 is connected to an orifice 10 opening into pipe 1 downstream of butterfly valve 5. The flow cross-sectional area provided by orifice 10 can be adjusted by means of a screw 11 retained in adjusted position by a spring 12. Duct 7 may also be connected to pipe 1 by a transfer orifice 13 which is so disposed that the edge of butterfly valve 5 moves from downstream to upstream of it when the valve is partly opened from the minimum opening position shown in FIG. 1.

An idling regulator 20 comprises a casing made up of assembled parts and which is mounted on the carburettor body. A tubular housing 23 is secured to one of the parts 24 of the casing and its internal compartment contains a flexible evacuated bellows of a type conventionally used as an aneroid capsule 21. A first pneumatic element consisting of the housing 23 and aneroid capsule 21 constitutes the sensing element of the idling regulator 20. Compartment 22 is connected to that part of the carburettor intake pipe 1 which is downstream of butterfly valve 5 by a duct 25 formed in the wall of part 24, a duct 26 and a connecting line 27 provided with a calibrated restriction 15. As a consequence, the underpressure or vacuum which prevails downstream of butterfly valve 5 is transmitted to compartment 22. The position of an end of capsule 21 in compartment 22 is adjustable by a threaded rod 28 secured to capsule 21 and screwed into a threaded part of body 23. A nut 29 screwed into a threaded rod 28 is adapted to secure it in position after adjustment. A rod 30 secured to the movable end of capsule 21, moves when variations occur in the underpressure in that part of pipe 1 downstream of the butterfly valve 5. Rod 30 is slidingly received in an aperture 31 of part 34 and projects beyond that part.

In the embodiment shown in FIG. 1, the free end of rod 30 acts as a movable abutment for a valve 35 mounted in the middle of a movable force applying part of a second pneumatic element 36. That movable part comprises a diaphragm 37 clamped between dish-like members 38 and 39 secured together by screws 40 and 41. It separates a first chamber 47, which is connected to that part of pipe 1 downstream of valve 5 by a calibrated restriction 48, duct 26 and connecting line 27, from a second chamber 49 maintained at atmospheric pressure by an orifice 50. Valve 35 has a first cylindrical portion **35*a* slidably mounted in member 38 and a second cylindrical portion 35*b* for abutment against the end of rod 30. A return spring 42 is compressed between member 38 and a washer 43 retained by a clip 44 engaging in a groove in the cylindrical member 35*b*. Spring 42 tends to urge valve 45 against member 38. When the valve is thus forcibly applied against member 38, it closes orifices 45 and 46 formed in member 38 and which connect chamber 47 and a compartment 51 in member 39. Compartment 51 is maintained at atmospheric pressure by apertures 52 and 53**.

A part 54 and member 24 form the casing of pneumatic element 36. Parts 24 and 54 clamp the peripheral part of diagram 37. Member 54 serves as an abutment for the movable part of pneumatic element 36, when the pneumatic force exerted on diaphragm 37 by the underpressure prevailing in chamber 47 is less than the force of a return spring 55.

Finally, a lug 56 of member 39 is connected by a rod 57 to a lever 58 mounted for rotation about the shaft 6 of butterfly valve 5. A stud 59 of lever 58 has a unidirectional or one-way connection with a lever 60 secured to valve 5, for movement in the opening direction thereof.

Operation of the device is as follows:

Depending on the load on the engine, a predetermined idling speed "$N_o$" is achieved with the butterfly valve being opened to amounts $\alpha_0$, $\alpha_1$, $\alpha_2$, . . . (FIG. 2) which increases in proportion to the load on the engine. These degrees of opening correspond to pressures P0, P1, P2 in that part of pipe 1 downstream of the butterfly valve 5.

Each value of pressure P is characteristic of the load on the engine running at speed $N_o$ and corresponds to a given state of the aneroid capsule 21 and consequently to a position of the free end of rod 30, since the pressure P is transmitted via connecting line 27, duct 26 and duct 25 to the chamber 22 containing the capsule.

When the engine idles at minimum load, i.e. at the load corresponding only to friction inside the engine, butterfly valve 5 is in the minimum opening position $\alpha_0$ and pressure P has the value PO. Under these conditions, no corrective action is required by regulator 20. Regulator 20 will be adjusted so that, under these conditions, the free end of rod 30 holds the movable part of pneumatic element 36 against component 54, as shown by dash-dot lines in FIG. 1.

Figure 2:
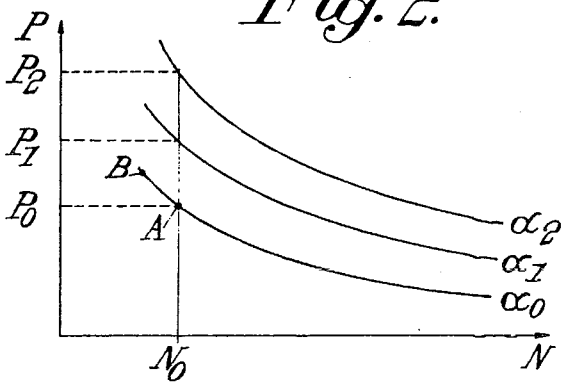
FIG. 2 is a diagram showing the relation between the engine running speed "N" and the pressure "P" in that part of the intake pipe downstream of the main throttle member, for various amounts of opening $\alpha_0$, $\alpha_1$ and $\alpha_2$ of the throttle member.

If the load on the engine suddenly increases from its minimum value, the engine tends to slow up and its operating point on the diagram in FIG. 2 tends to move from A to B, whereupon the regulator comes into action. When pressure P increases, capsule 21 contracts and moves the rod 30. Valve 35 closes. The pressure decreases in chamber 47 until it reaches the new value P transmitted by connecting line 27, duct 26 and calibrated orifice 48. The movable part of pneumatic element 36 moves against the action of spring 55 until the part **35*b* of valve 35 abuts the free end of rod 30; after which valve 35 tends to open and air enters chamber 47 through orifices 45 and 46, bringing the pressure in chamber 47 to a value such that the movable part of element 36 again tends to move away from rod 30 and valve 35 tends to close; the pressure then decreases in chamber 47 and valve 35 is again brought in contact with the end of rod 30, and so on. The movable part of element 36 rapidly reaches equilibrium if the calibrated orifices 15 and 48 are suitably selected. At equilibrium, valve 35 provides a leak cross-sectional area which depends on the flow cross-sectional area provided by orifices 15 and 48**.

The resulting balance conditions correspond to wider opening of valve 5, to an extent depending on rod 57, lever 58, stud 59 and lever 60, as shown in FIG. 3.

If the stiffness of the aneroid capsule and the amplifying effect introduced by lever 58 have been suitably selected, the new degree of opening $\alpha$ of valve 5 maintains the engine idling speed at substantially the value $N_o$.

The force of spring 42 is selected at the lowest possible value (a few grammes) compatible with satisfactory operation, so that the force exerted by valve 35 on rod 30 and consequently on the aneroid capsule is practically negligible and the capsule is not subjected to appreciable stresses.

A number of modified embodiments are possible. For instance, the first pneumatic element may be a pneumatic capsule comprising a deformable or movable element such as a diaphragm, one surface of which is subjected to the underpressure transmitted from the intake pipe through the calibrated orifice 15 and the connection 27.

I claim:

1. A carburation device for internal combustion engine, comprising:
an intake pipe,
an operator operable main throttle member in said intake pipe,
stop means for preventing said throttle member from closing beyond a predetermined minimum opening position by which an air flow cross-section is defined by the throttle member in the intake pipe,
an idling circuit constructed to receive fuel and air and terminating into a part of said intake pipe downstream of said throttle member,
and idling regulator means which includes:
a first pneumatic element having movable wall means,
means for connecting said element to said part of the intake pipe so that the position of the movable wall means is determined by the degree of underpressure in said part of the intake pipe,
a second pneumatic element having force applying wall means drivably connected to said main throttle member via a one-way connection to move said throttle member in the direction of opening,
and valve means carried by the force applying drive wall means arranged to be engaged and actuated by the wall means of said first pneumatic element upon movement of said wall means of said first pneumatic element toward said force applying wall means responsive to increase of said degree of underpressure, said valve means upon actuation thereof modifying the underpressure applied to said force applying wall means whereby the latter is moved in the direction corresponding to a decrease in the minimum degree of opening of said throttle.

2. A carburation device according to claim 1, wherein said force applying wall means defines a chamber connected to said part of the intake pipe via a calibrated orifice and to atmosphere via said valve means.

3. A carburation device according to claim 2, having resilient means, such as a spring, for subjecting the force applying wall means to a force opposing the force exerted by the underpressure on said force applying wall means.

4. A carburation device according to claim 1, wherein the first pneumatic element comprises an aneroid capsule located in a compartment connected to that part of the intake pipe downstream of the main throttle means.

5. A device according to claim 4, wherein a calibrated orifice is disposed between the compartment and the intake pipe.

6. A device according to claim 5, wherein the stiffness of the aneroid capsule is selected to maintain the engine idling speed at a value substantially independent of the engine load.

7. A device according to claim 4, wherein the capsule has a rod adapted to abut the valve and projecting through partition wall means separating a chamber from the compartment containing the capsule.

8. A carburation device for internal combustion engine, comprising:
an intake pipe,
an operator operable main throttle member in said intake pipe,
an idling circuit constructed to receive fuel and air and terminating into a part of said intake pipe downstream of said throttle member,
an idling regulator means which includes:
a first pneumatic element having an aneroid capsule located in a fixed housing defining a compartment connected to said part of the intake pipe so that the position of a movable end wall of said capsule is determined by the degree of underpressure in said part of the intake pipe,
a second pneumatic element having a casing which contains transverse movable force applying wall means drivably connected to said main throttle member via a one-way connection to move said main throttle member in the direction of opening, dividing the interior of said casing into a first chamber connected to said part of the intake pipe via a restriction and a second chamber connected to atmospheric pressure,
spring means for urging said force applying wall means into a direction rendering said one-way connection inoperative,
and normally closed valve means carried by said force applying wall means arranged to be actuated toward opening by said movable end wall means of said aneroid capsule so that an increase of said degree of underpressure modifies the underpressure applied to said force applying wall means for the latter to decrease a minimum degree of opening of said throttle member.

9. A carburation device for internal combustion engine; comprising:
an intake pipe,
an operator operable main throttle member in said intake pipe,
an idling circuit constructed to receive fuel and air and terminating into a part of said intake pipe downstream of said throttle member,
and idling regulator means which includes:
a first pneumatic element having an aneroid capsule located in a fixed housing defining a compartment connected to said part of the intake pipe so that the position of a movable end wall of said capsule is determined by the degree of underpressure in said part of the intake pipe,
a second pneumatic element having an casing which contains transverse movable force applying wall means drivably connected to said main throttle member via a one-way connection to move said main throttle member in the direction of opening, dividing the interior of said casing into a first chamber connected to said part of the intakepipe via a restriction and a second chamber connected to atmospheric pressure, whereby the underpressure which prevails in operation in said part of the intake pipe is applied via said restriction to said first chamber,
spring means for urging said force applying wall means into a direction rendering said one-way connection inoperative in opposition to any underpressure prevailing in said first chamber,
and normally closed valve means carried by said force applying wall means and located in the path of movement of said movable end wall whereby it is actuated toward opening by said movable end wall means of said aneroid capsule upon increase of said degree of underpressure and said force applying wall means follows up the displacements of said end wall in operation.

* * * * *